US008475342B2

(12) United States Patent
Flowers et al.

(10) Patent No.: US 8,475,342 B2
(45) Date of Patent: Jul. 2, 2013

(54) INFANT CRAWLER-WALKER MOTOR DEVELOPMENT APPARATUS

(76) Inventors: Daniel William Flowers, Rush City, MN (US); James William Flowers, Rush City, MN (US)

( * ) Notice: Subject to any disclaimer, the term of this patent is extended or adjusted under 35 U.S.C. 154(b) by 211 days.

(21) Appl. No.: 12/803,756

(22) Filed: Jul. 3, 2010

(65) Prior Publication Data

US 2011/0009245 A1 Jan. 13, 2011

Related U.S. Application Data

(60) Provisional application No. 61/270,252, filed on Jul. 3, 2009.

(51) Int. Cl.

| | |
|---|---|
| ***A47D 13/04*** | (2006.01) |
| ***A61H 3/00*** | (2006.01) |
| ***A63B 22/00*** | (2006.01) |
| ***A63B 22/14*** | (2006.01) |
| ***A63B 26/00*** | (2006.01) |
| ***G09B 19/00*** | (2006.01) |
| ***A63G 1/12*** | (2006.01) |

(52) U.S. Cl.

USPC ..... 482/69; 482/143; 434/255; 472/14; 472/15

(58) Field of Classification Search

USPC ..... 482/51, 54, 40, 43, 126, 124, 23, 482/33, 38–39, 66–69, 95–96, 139, 142–143; 297/274, 275, 276, 277; 601/23, 35; 472/135, 472/1, 14–17; 434/247, 255

See application file for complete search history.

(56) References Cited

U.S. PATENT DOCUMENTS

| | | | | | |
|---|---|---|---|---|---|
| 691,494 | A | * | 1/1902 | Schindler | 472/14 |
| 1,073,918 | A | * | 9/1913 | Mason | 472/14 |
| 2,499,164 | A | * | 2/1950 | Richardson | 472/15 |
| 3,049,350 | A | | 8/1962 | Walker | |
| 3,730,587 | A | * | 5/1973 | Bloxham et al. | 297/274 |
| 4,569,532 | A | | 2/1986 | Mirkarimi | |
| 4,844,452 | A | | 7/1989 | Tomosky | |
| 5,211,607 | A | | 5/1993 | Fermaglish | |
| 5,458,550 | A | * | 10/1995 | Braim et al. | 482/69 |
| 7,326,152 | B2 | | 2/2008 | Gates | |

* cited by examiner

*Primary Examiner* — Oren Ginsberg

(57) ABSTRACT

This invention relates generally to a portable child development station. More specifically, an infant crawling and walking aid. The invention is collapsible and can be stored in smaller confines. When the invention is set up, it is structurally sound and safe with detachable variations allowing assistance in crawling as well as walking by suspending the infant with variable height adjustments to accommodate infant.

4 Claims, 14 Drawing Sheets

INFANT CRAWLER-WALKER MOTOR DEVELOPMENT APPARATUS

CROSS-REFERENCE TO RELATED APPLICATIONS

This application claims the benefit of provisional patent application Ser. No. 61/270,252, filed in 2009 Jul. 3 by the present inventors

BACKGROUND

1. Prior Art

The following is a tabulation of some prior art that presently appears relevant:

| U.S. Patents | | | |
|---|---|---|---|
| Patent Number | Kind Code | Issue Date | Patentee |
| 7,326,152 | B2 | 2008 Feb. 5 | Gates |
| 3,730,587 | A | 1973 May 1 | Bloxham |
| 5,211,607 | A | 1993 May 18 | Fermaglish |
| 3,049,350 | A | 1962 Aug. 14 | Walker |
| 4,844,452 | A | 1989 Jul. 4 | Tomosky |
| 4,569,532 | A | 1986 Feb. 11 | Mirkarimi |

2. Background of the Invention

At birth, an infant's body and brain is not fully developed. The corpus callosum is a neurological passageway communicating information between the left and right brain hemispheres. This allows the body to use both eyes, both ears, both hands and both feet in conjunction, as well as storing and retrieving information. Myelin, a fatty substance in the brain helps neurons send and return information to the brain, brain stem and spinal cord. Neuroscience research has shown that the parts of the brain that control movement also control cognition and emotion. Early infant physical development can improve this cerebral connection and its transmission of information. Gross motor skills including but not limiting: memory, muscle tone, strength, and hand/eye coordination can be improved through a repetitive, cross lateral movement, such as crawling at an early age. Therefore, if an infant/user spends much of its early age crawling or learning to crawl, it is equally improving its brain function/development rate.

A variety of infant walkers have been proposed—for example, in U.S. Pat. No. 7,326,152 (2008) to Gates, and 3,730,587 (1973) to Bloxham, and U.S. Pat. No. 5,211,607 (1993) to Fermaglish. Although these walkers allow the infant/user to move on their feet in revolutions around a central-positioned structural column, they are not, however designed to harness an infant/user from the torso, allowing the infant/user to "crawl" on both knees and both hands, bypassing an earlier stage of the infants' age which can be integral to early childhood development.

Many infant walkers (not including U.S. Pat. No. 3,730,587) may restrict the vision of the infants lower limbs do to a device obstruction such as a tray or even the supporting means itself, resulting in a lesser development of hand/eye coordination. In addition to visual obstructions, such infant walkers with height settings are not elasticized, permitting the infant to bounce and build up the much needed physical strength to later walk independently. Because of these aforementioned restrictions, the infant may become "comfortable" sitting in the walker seat until it is not even attempting to walk preventing the intended developmental purpose.

U.S. Pat. No. 4,569,532 (1986) to Mirkarimi enables an infant that already has proper strength to crawl, to roam freely near unobstructed locations such as a stairway, causing a dangerous environment for the infant. If an infant has not yet built sufficient strength to crawl, the infant will have the task of carrying the weight of the device thereof; resulting in additional strength needed to utilize the device, but nevertheless all the crawling and walking aids suffer from a number of disadvantages:

(a) By not allowing infant/user to suspend in a "crawling" position with a padded harness around infants torso, walkers prevent the infant from moving on both hands and both knees in a locomotive, cross-lateral manner. This prevents walkers from improving trunk muscles and coordination of all four limbs.

(b) Walkers with stationary seating, that is, walkers that do not allow the infant to bounce up and down can promote the infant to just sit in the seat making movement of their legs less desirable.

(c) Prior walkers that do allow the infant to suspend in walking position have many more required parts to complete the intended function of device due to weight balance needed to support the infant, resulting in a higher cost of materials and manufacturing.

(d) Prior walkers are not designed to be as freely adjustable as the present embodiment. This lack of adjustment restricts the infant to a specific height making the device less accommodating to the variable heights, lengths, and weight of each respective infant/user.

(e) Walkers that restrict the vision of the infant/user's legs can prevent the him/her from recognizing that it can control it's legs to move about freely.

(f) Prior walkers with central-positioned structures that are not detachable from center column to base, making it less portable.

(g) Prior walkers with central-positioned structures do not have a guide wheel that rolls on a plate on top of center column requiring additional means of function to support weight of infant.

SUMMARY

The present invention overcomes the above mentioned drawbacks and limitations by providing a crawling aid to assist the infant in crawling, enabling both sides of the brain to function in concert improving the corpus callosum at a much earlier and important brain development age. In addition, the present embodiment allows for an attachment to support the infant around the crotch and waist to then allow the infant/user to walk/jump in revolutions around the center column.

Advantages

While the infant is held up by a padded harness holding its torso in a conventional "crawling" position, the infant is able to crawl around the base and column in revolutions exploring its surroundings, simultaneously visualizing its locomotive movements-improving its grasp of motor development and binocular vision. For example, if the supervising user assisting the infant in the crawling apparatus, places a toy just out of reach of the infant, the infant can attempt to move to the toy. The infant will later realize that she can control all of her limbs and start to bounce until she performs a locomotive act of crawling. While the infant is moving, she can see the toy and her eyes will begin to focus and improve binocular vision. while the infant is also able to "bounce" building up much needed muscles for a later walking development stage. By being elastically suspended in the cushioned harness over the padded floor, the infants carrying weight is reduced making it easier for the infant to push off the padded floor in an attempt to crawl. When the infant is not in the apparatus, she may remember the position she was in when in using the apparatus, and attempt to crawl on her own.

A pivot arm is connected to the top of a bearing assembly. The bearing assembly is situated on the top-center of a plate. A guide wheel is connected to bottom of pivot arm to roll on top of outer end of plate, which supports the bearing assembly by carrying a portion of infant/user weight around the center column. This aids the infant/user by reducing the load weight of their body so the infant/user can move with ease, while not obstructing the vision of the infant/user. The present embodiment can allow any height of harness within elasticized cord limitations by locking said cord to desired length.

In addition to assisting the infant in crawling, the present embodiment can also attach a jumper seat. The jumper seat has cords attached to top of seat in both front and rear of jumper. The upper portion of jumper cords are connected to a fixed cord support embodiment with means of connecting to adjustable cord. On one side of the cord support is a handle that is used to lift jumper seat to attach to adjustable cord.

By using this device, the infant, at a much earlier age than that of walkers can improve numerous areas of early childhood development such as gross/fine motor skills, binocular vision, muscle strength and space/depth perception. The attachable jumper seat allows the infant to bounce up and down and walk around the device. There are no obstructions to prevent infant from seeing its left and right legs moving in concert. The Infant and also move laterally because of a bearing assembly placed above the pivot arm bearing assembly on outer end of pivot arm, the infant can turn its body in a full 360 degree radius allowing both clockwise and counter-clockwise rotating travel. The infant can utilize this invention from-when it's old enough to lift it's head-to when the infant is able to walk on its own, making the life of this device far longer than most walker apparatuses readily available.

DRAWINGS

Figures

For a more in depth understanding of present invention reference should be made to the detailed description of preferred and alternative embodiments and associated drawings wherein:

FIG. 6 is a top view of the top half of the invention showing the pivot arm bracket with caster wheel attached to the bearing housing assembly attached to guide plate and center column of.

Figure 8:
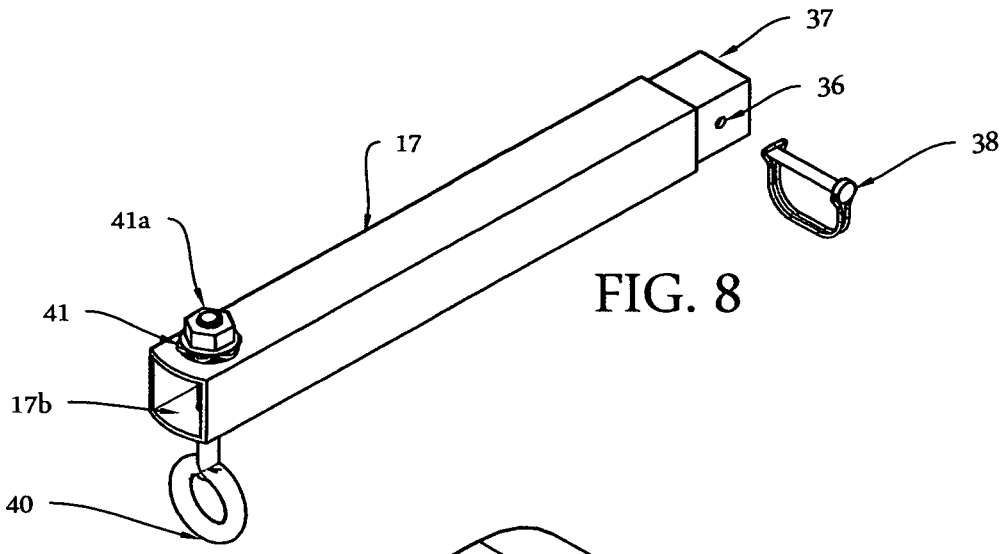
FIG. 8 is a perspective view of the pivot arm and locking pin with pivot arm bearing assembly connected to eyebolt.
Figure 8A:
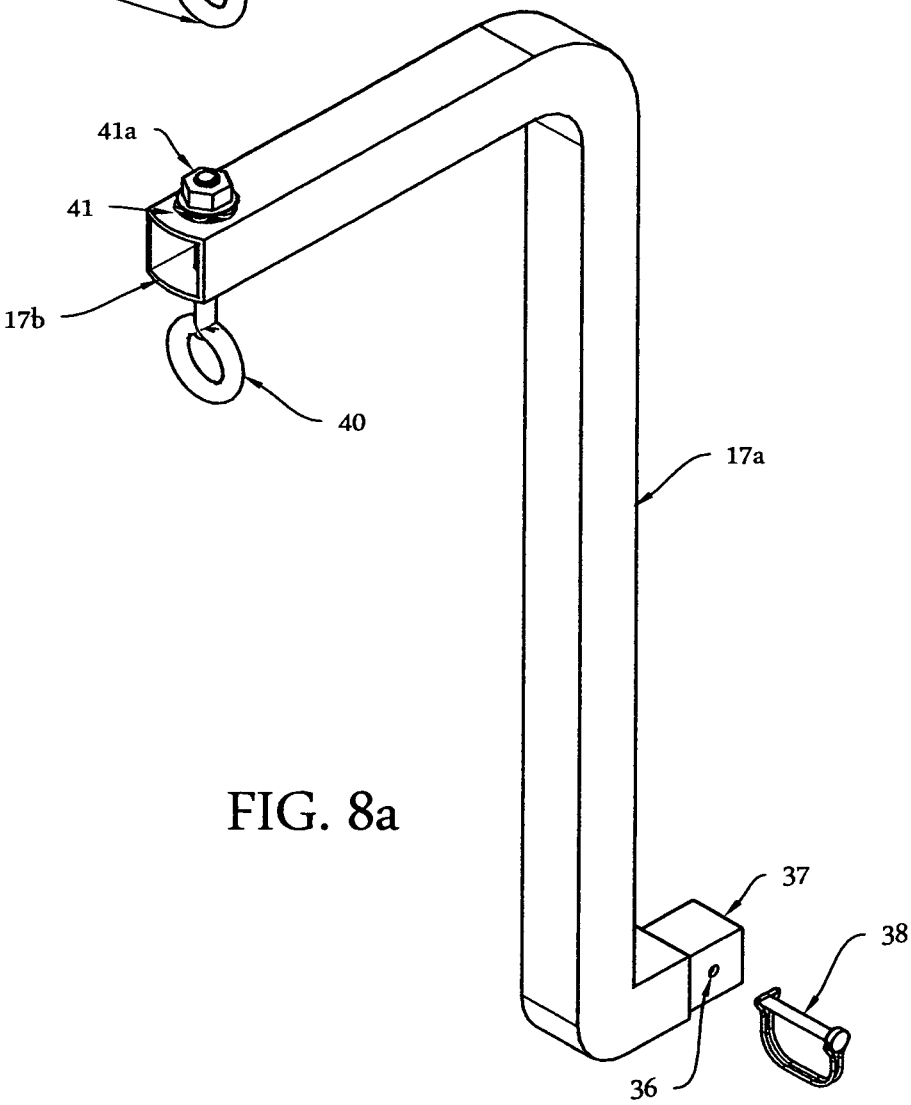

FIG. 8*a* is a perspective view of an additional pivot arm that raises the height of the elasticized cord embodiment for jumper attachment.

Figure 9:
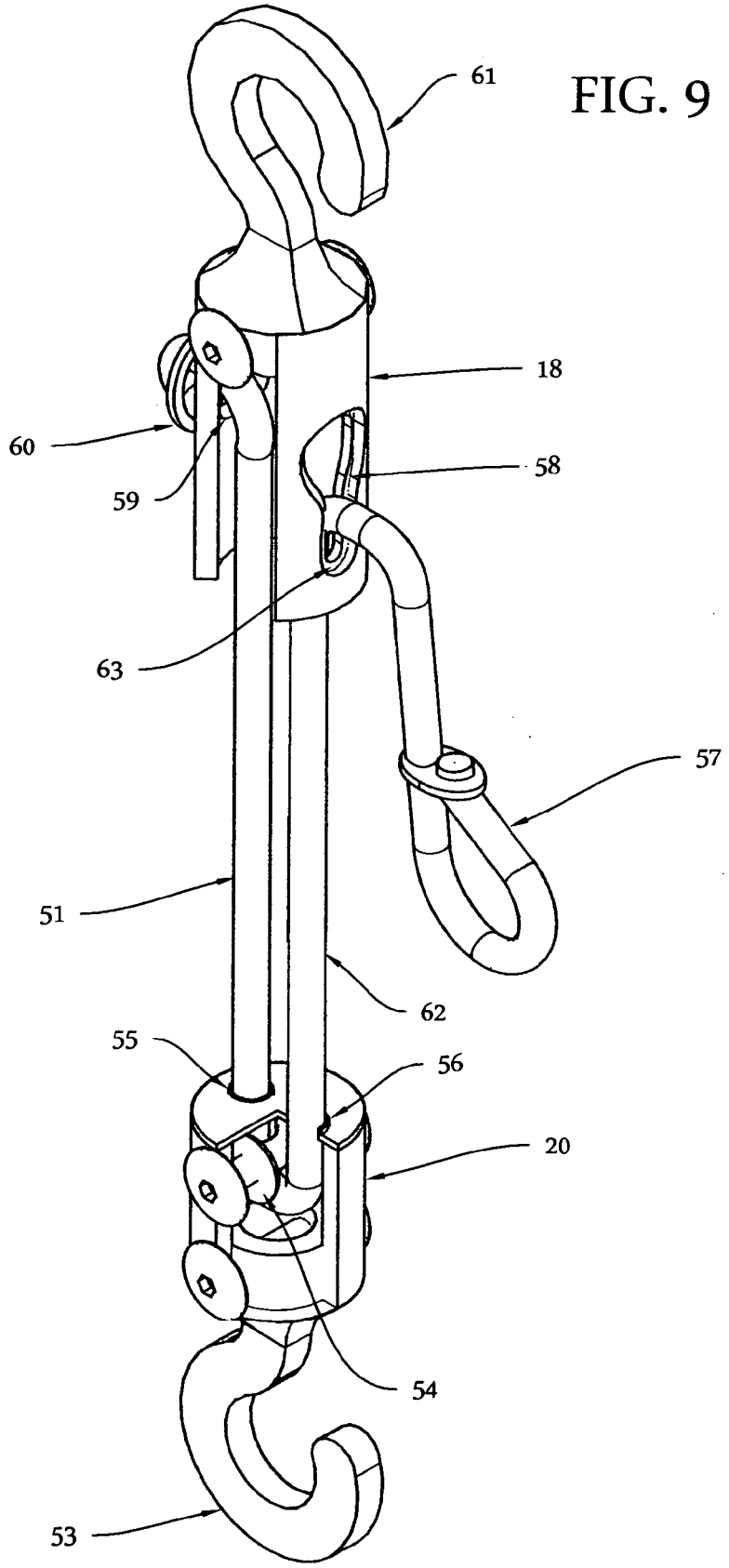

FIG. 9 is a perspective view of the elasticized cord embodiment including upper and lower cord housings and their associated means of attachment.

Figure 10:
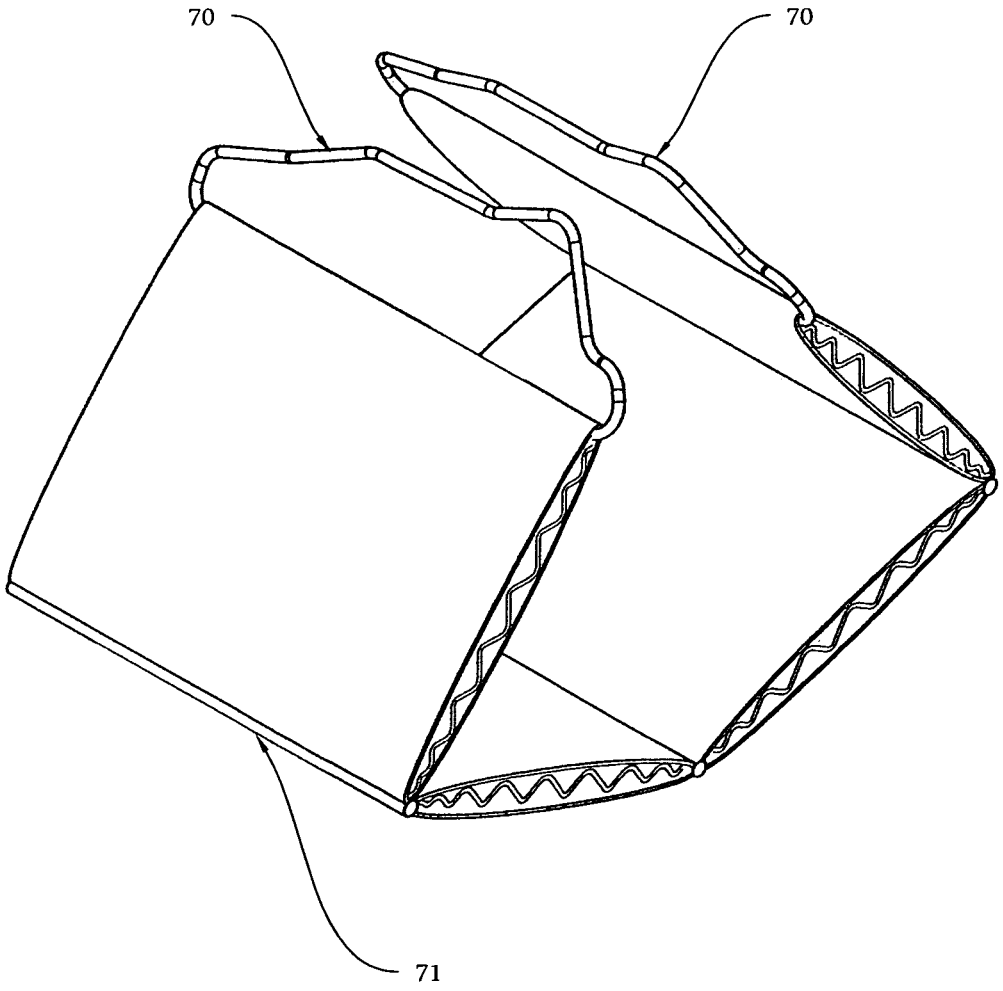

FIG. 10 is a perspective view of the crawling harness and its connecting handles.

Figure 11:
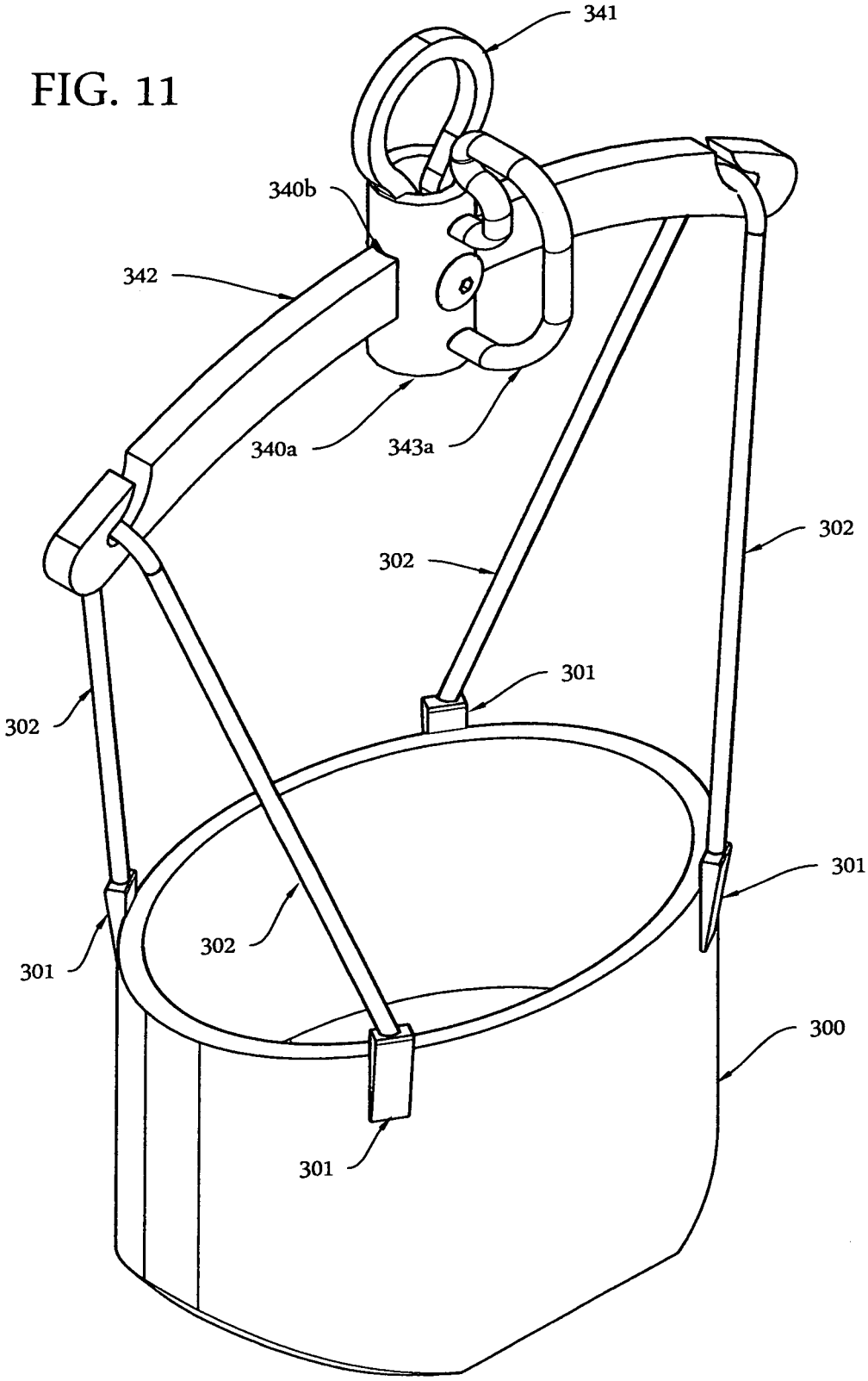

FIG. 11 is a perspective view of the jumper harness and harness support embodiment.

Figure 11A:
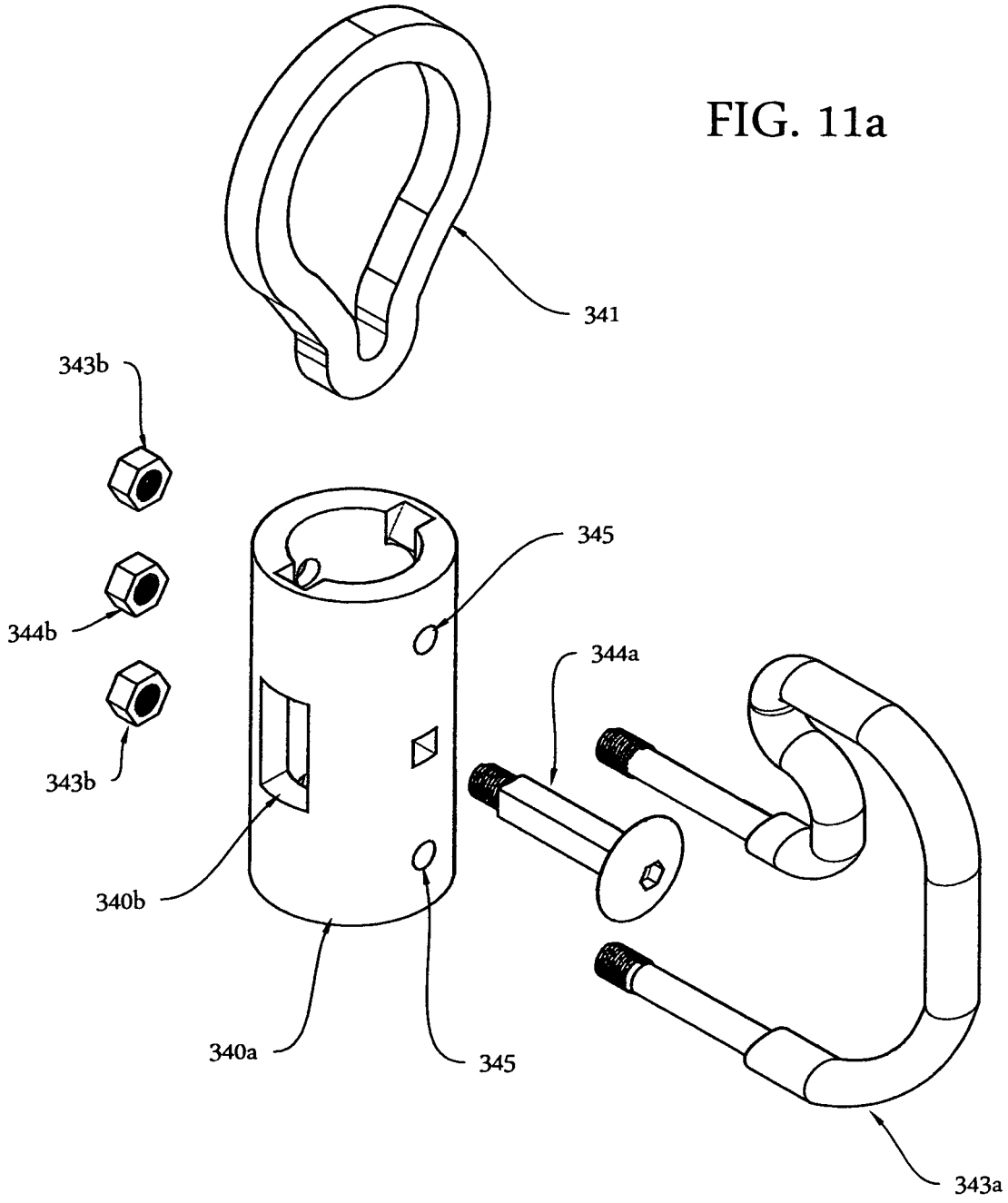

FIG. 11*a* is a perspective of the harness support connectivity of present jumper embodiment.

Figure 12A:
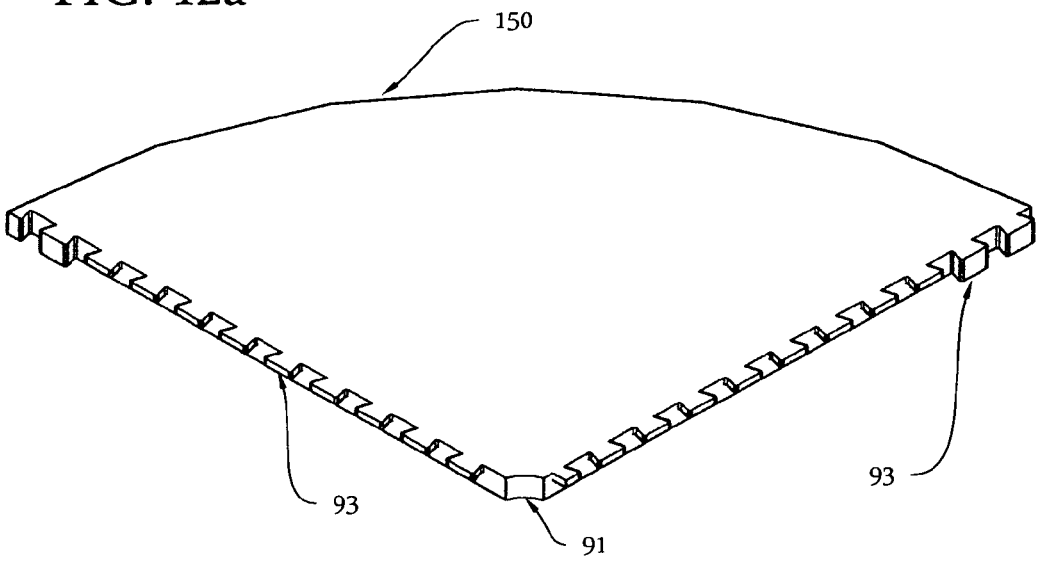
Figure 12:
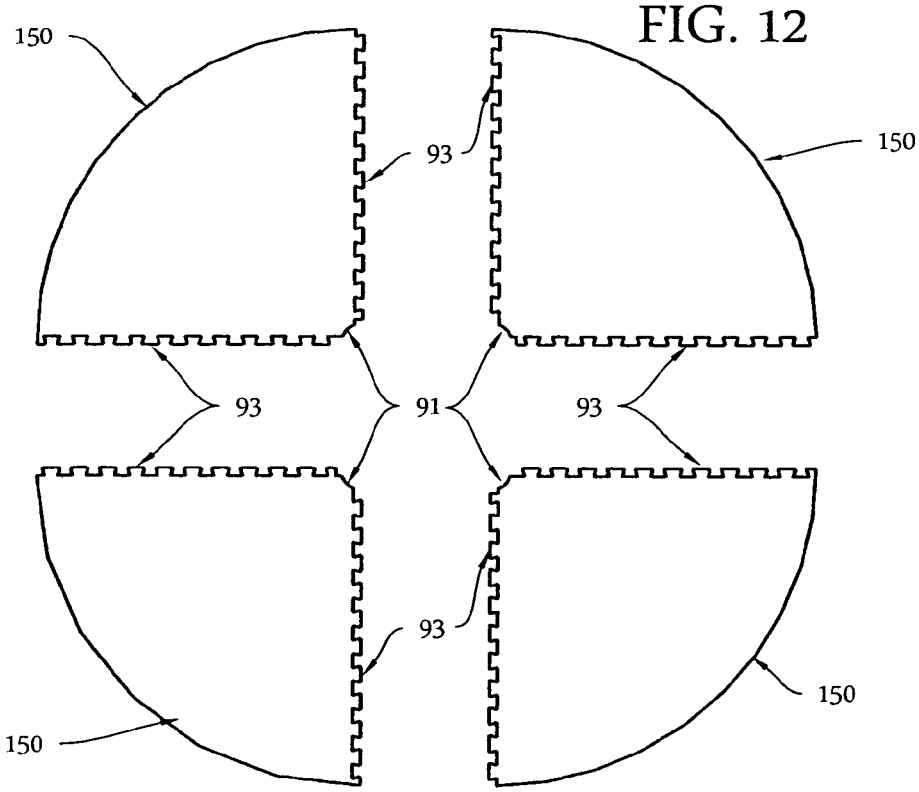

FIG. 12 is a top view of the padded flooring showing how the pieces interconnect around radius of center column.

FIG. 12*a* is an exploded view of an individual piece of padded flooring (and how center of piece covers sub plate if sub plate is used).

Figure 13:
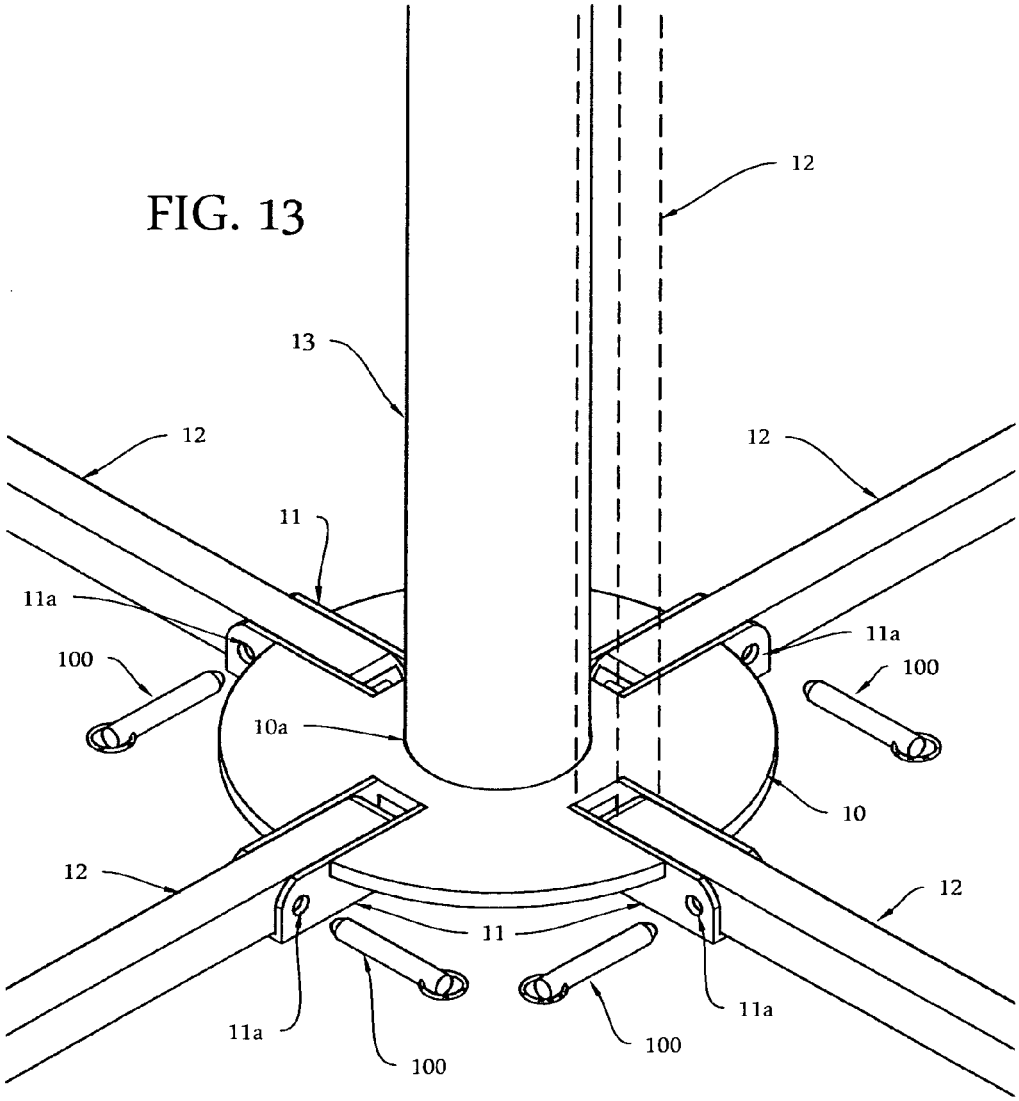

FIG. 13 is a perspective view of alternate base embodiment showing the development apparatus with base and connected swiveling support bars, and locking pins.

DETAILED DESCRIPTION OF THE INVENTION

Figure 1:
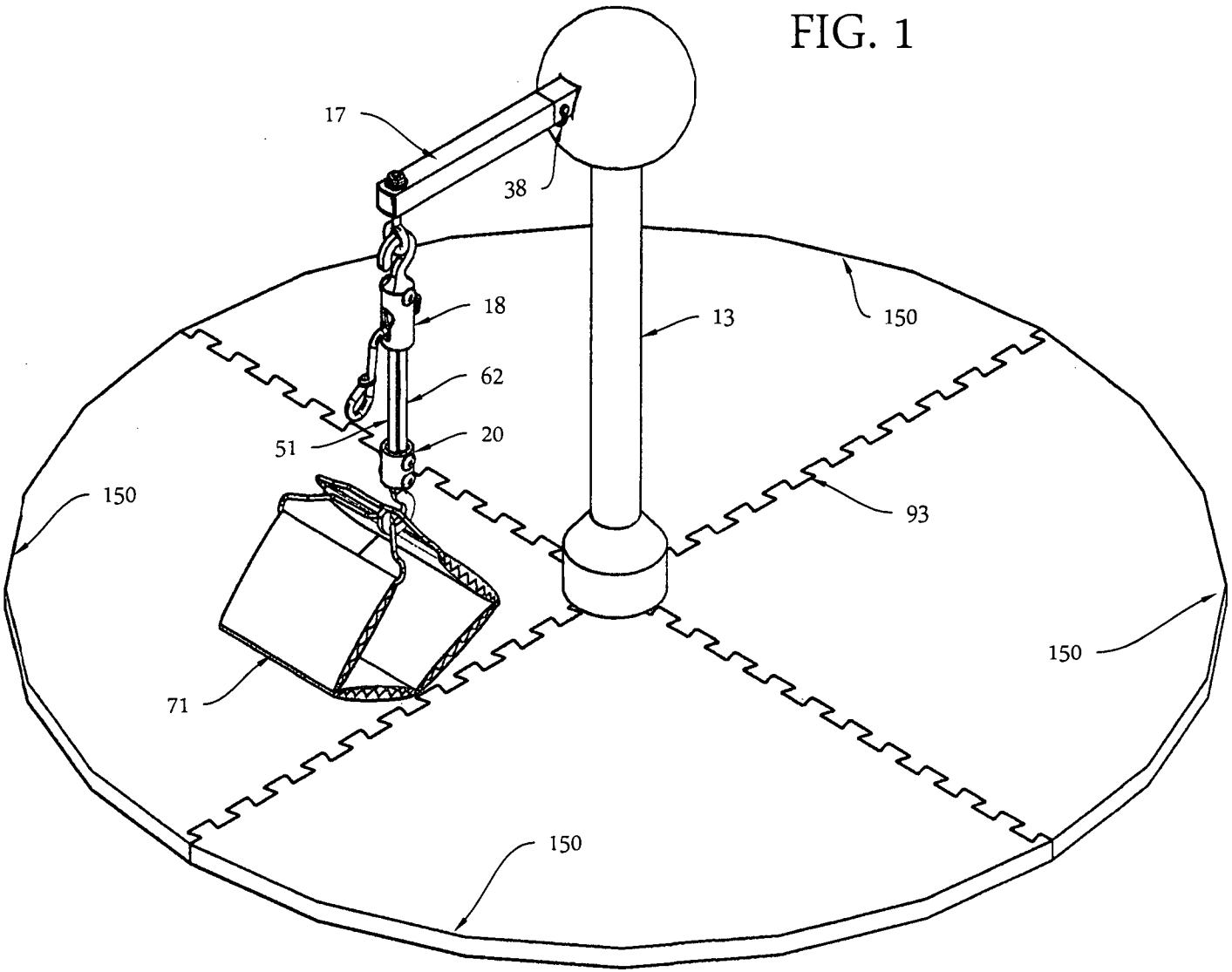
FIG. 1 is a perspective view of a portable infant development station in one embodiment of present invention.
Figure 2:
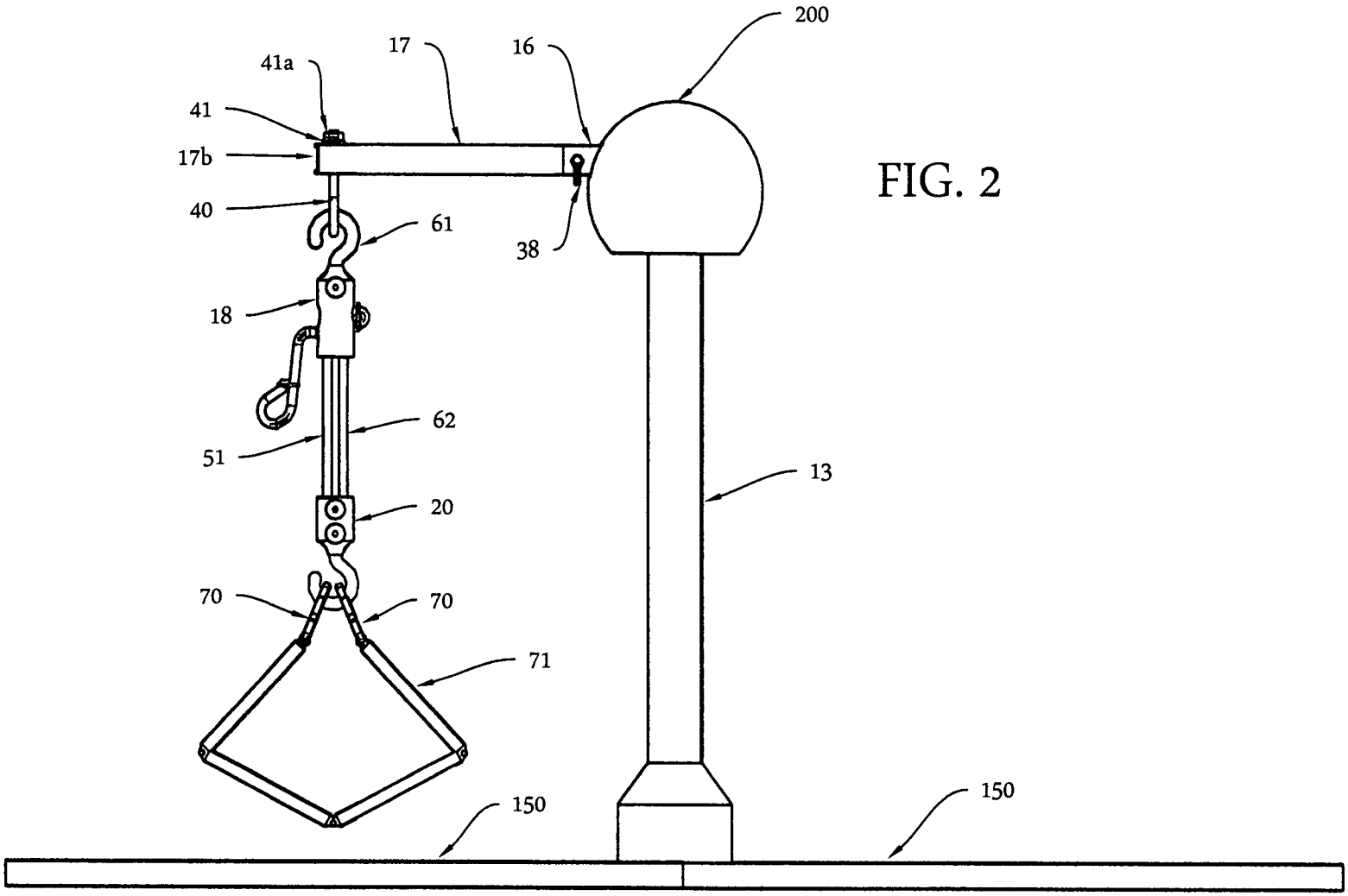
FIG. 2 is a side view of the infant development apparatus shown in FIG. 1 in assembled state of present invention.
Figure 3:
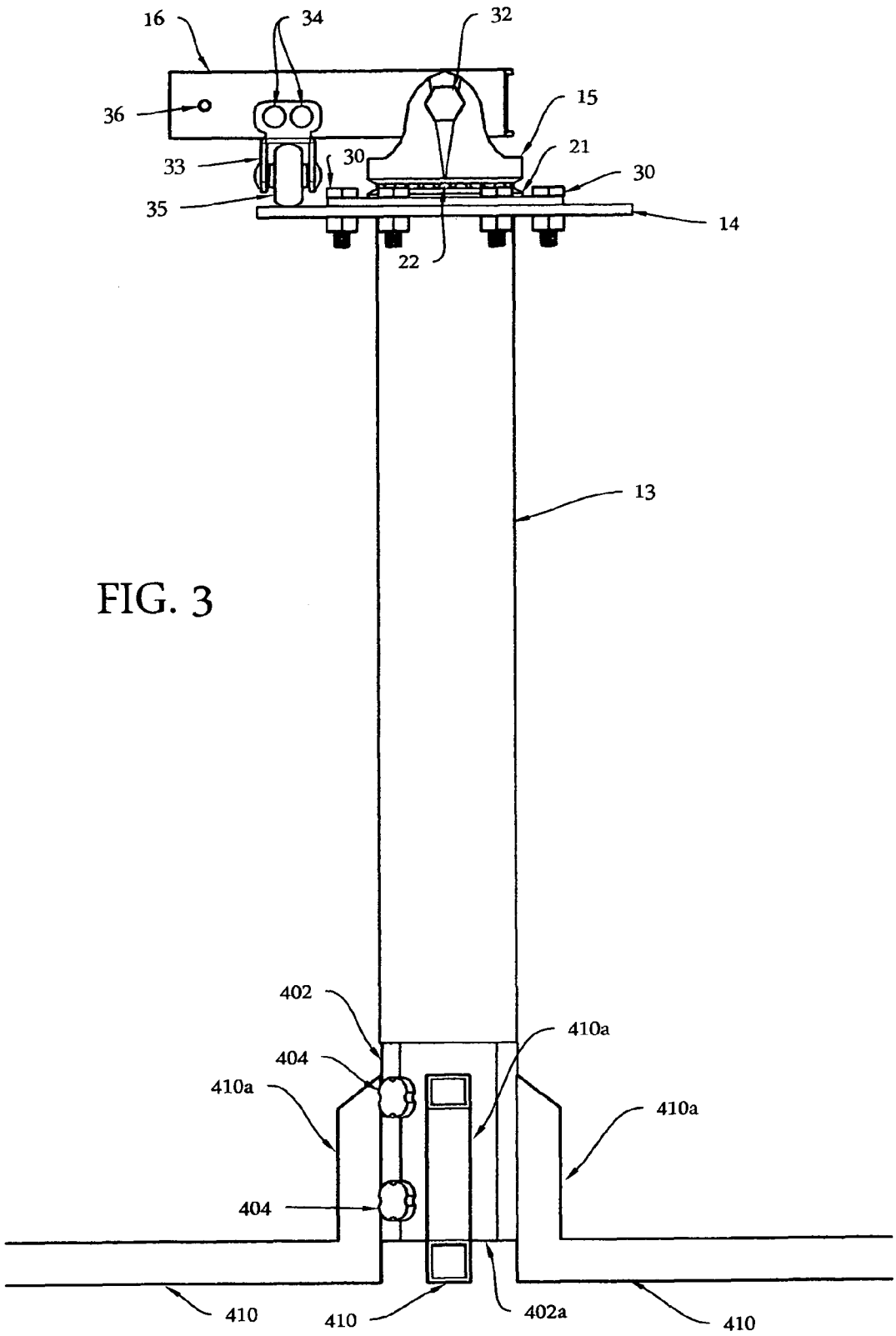
FIG. 3 is a side view of the development apparatus from its base, up to it's guide wheel and pivot arm.
Figure 4:
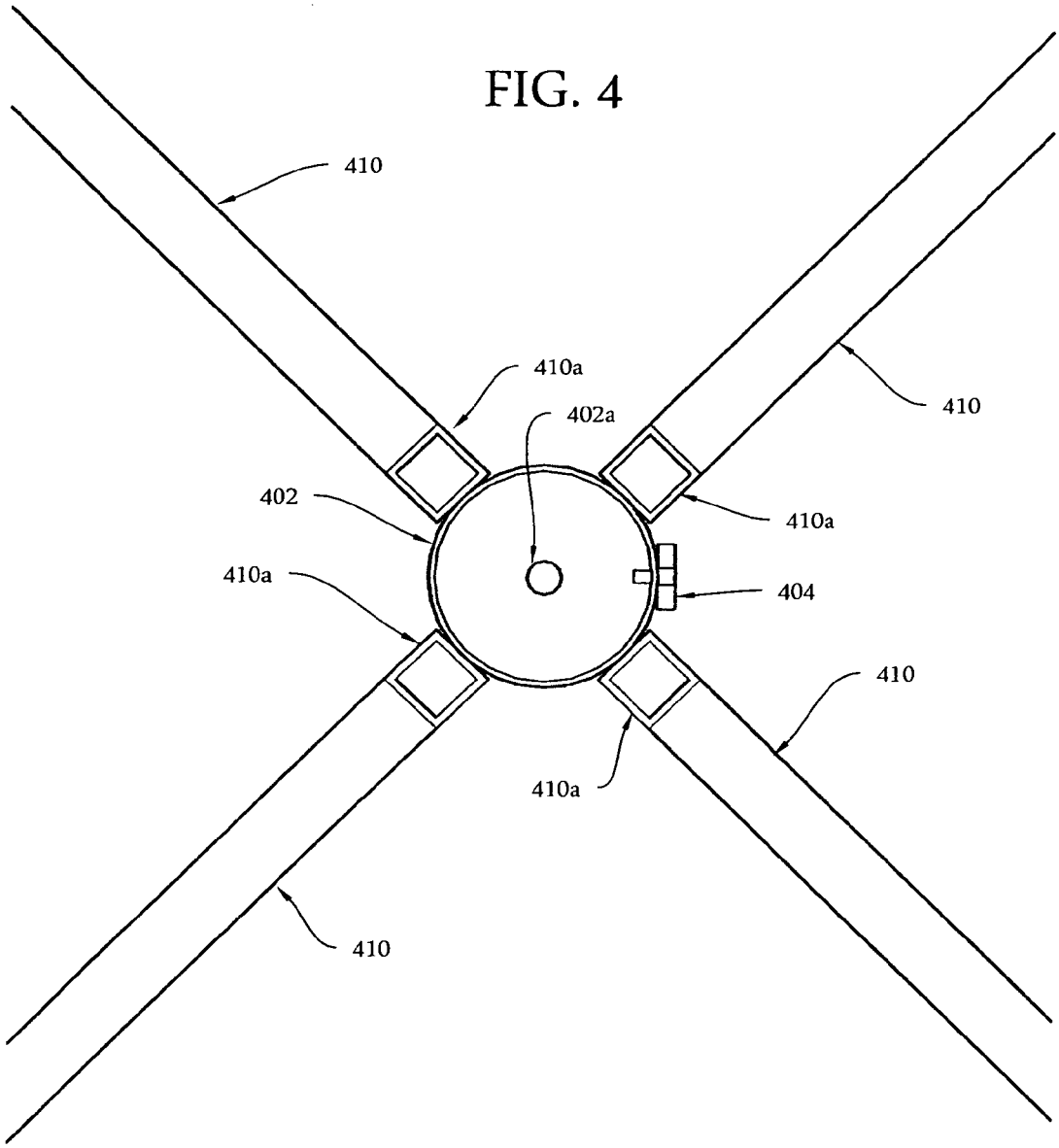
FIG. 4 is a top view of the bottom half of the invention showing the lower column, vertical, and support legs with locking knob.
Figure 5:
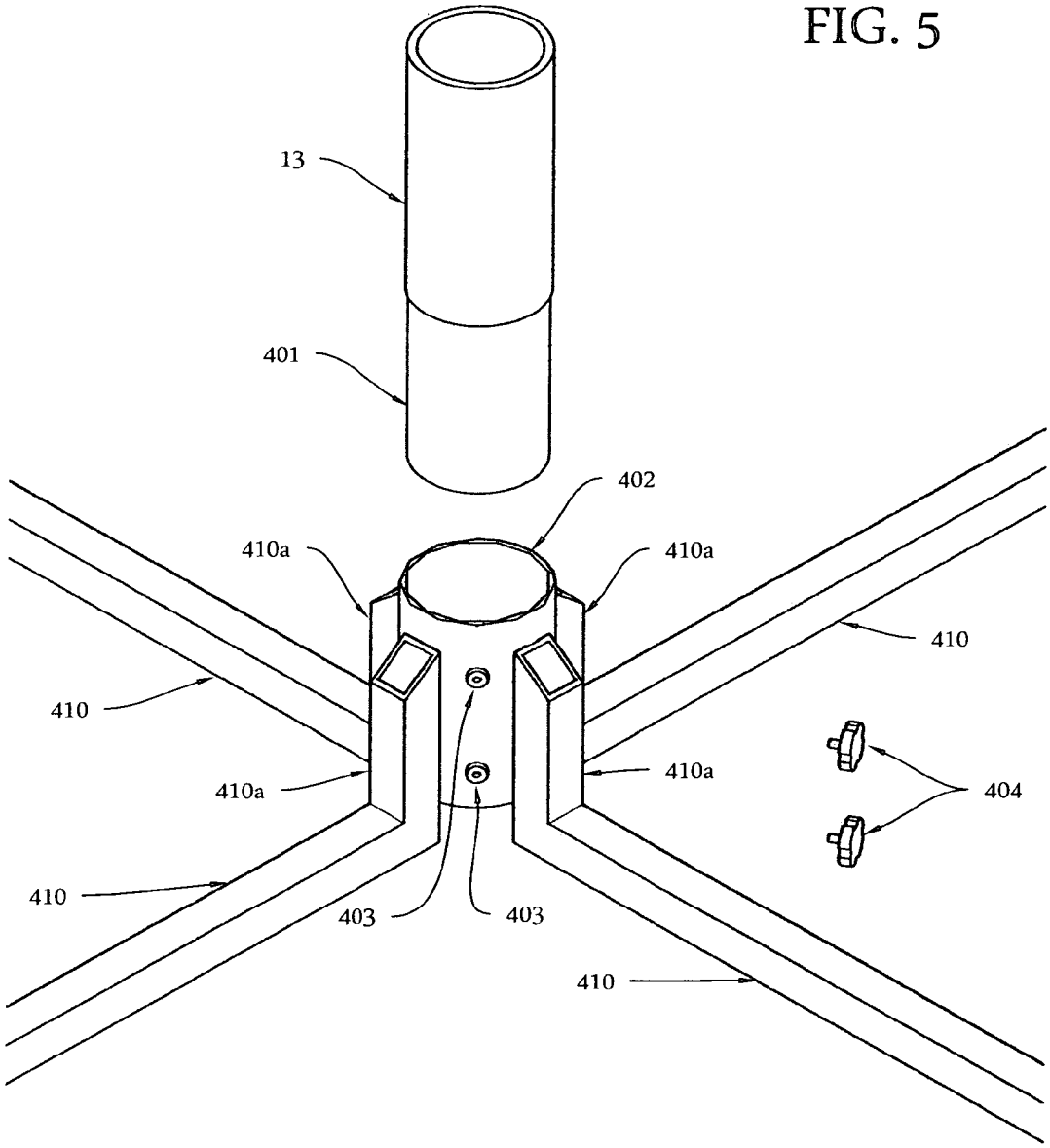
FIG. 5 is a perspective view of FIG. 4 with addition of center column showing how the lower column receives the center column with and locked in place with threaded locking knobs.

Referring more specifically to FIGS. 3, 4, and 5 wherein support legs 410 are preferably straight and made of metal, plastic or wood. Support legs 410 can be circular, square, oval or any other shape that is structurally suitable to withhold the present invention. Support legs 410 are fixedly attached to vertical legs 410*a* to make a 45 degree angle at the inner portion wherein vertical legs 410*a* are preferably welded to lower column 402. A lower column base 402*a* is fixedly attached to lower column 402 for additional support. Threaded holes 403 are preferably placed inline between any two of the vertical legs 410*a* wherein adjustable knob 404 removably screws into threaded holes 403.

A column 13 is preferably made of metal, plastic or wood material with a circular, square or oval shape. At the lower end of column 13 is a reduced column 401 made of same material that inserts into lower column base 402 wherein adjustable knob 404 pushes into reduced column to removably lock column 13 in place.

Figure 6:
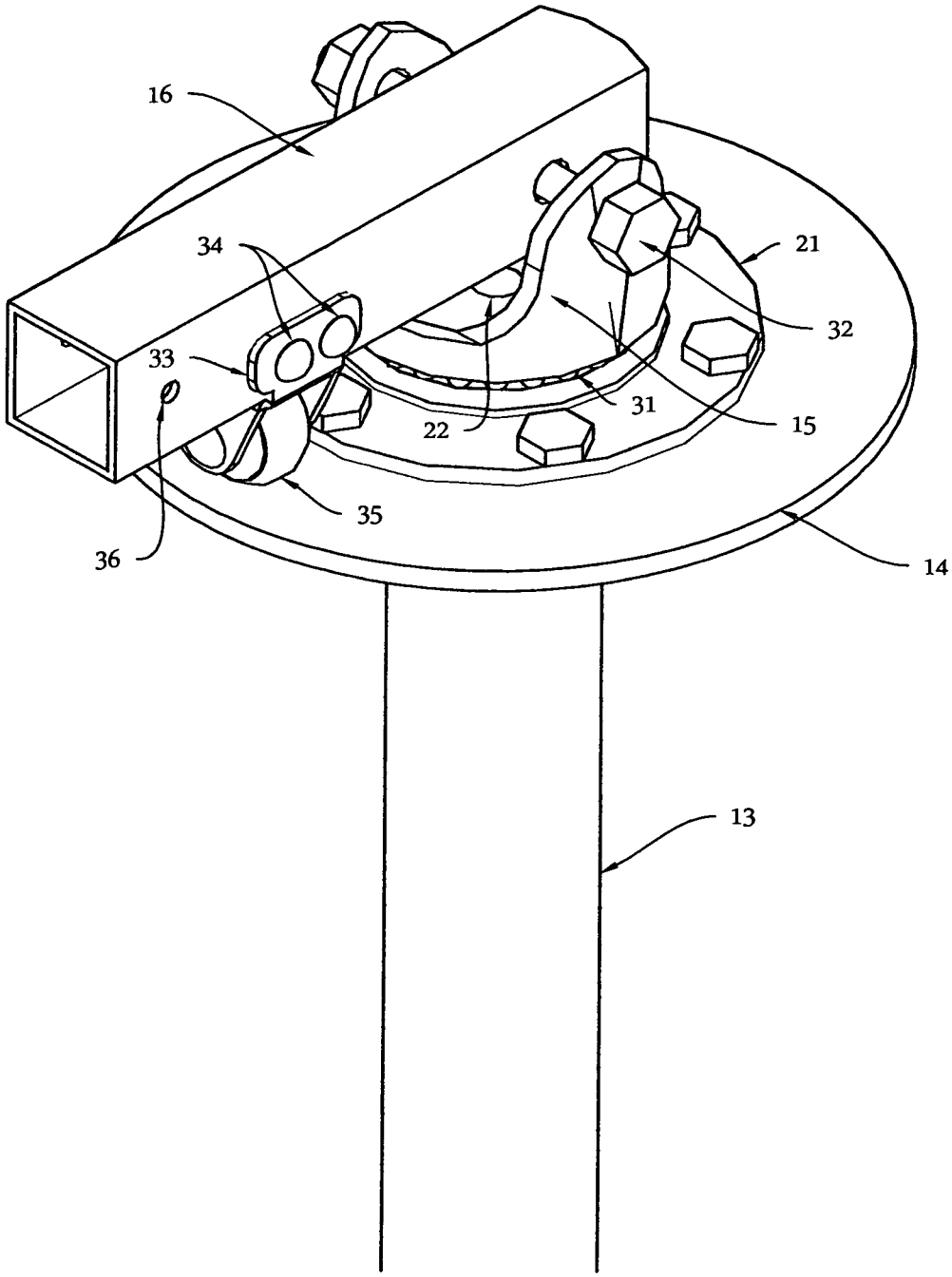
Figure 7:
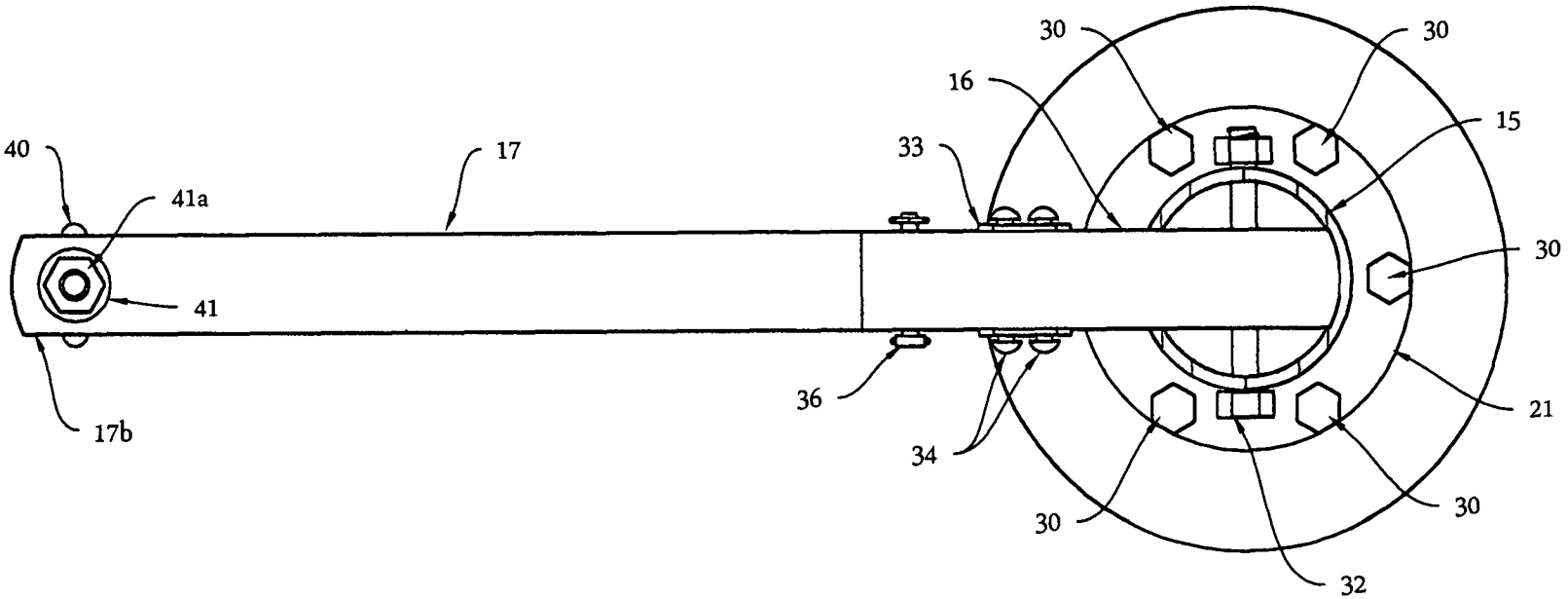
FIG. 7 is a top view of FIG. 6 showing the pivot arm locked in place with pivot arm bearing assembly of present invention.

Referring more specifically to FIGS. 3, 6, and 7 wherein upper guide plate 14 is fixedly attached to upper end of column 13 preferably by weldment and is made same material as column 13 with a circular, square or oval shape used to support a pivot arm bracket 16, guide wheel 35, and bearing assembly of preferred embodiment.

The Pivot arm bracket 16 is hingedly bolted to the upper bearing housing 15. Upper bearing housing 15 is connected to lower bearing housing 21 using a bolt 22 wherein upper bearing housing 15 pivots in revolution on conventional bearings 31. Lower bearing housing 21 is fixedly bolted to upper guide plate 14 using conventional nuts and bolts 30.

A guide wheel housing embodiment 33 is fixedly bolted to pivot arm bracket 16 using conventional nuts and bolts through throughholes 34 to outer end walls of the pivot arm bracket 16 wherein guide wheel 35 will roll on top of the upper guide plate 14 to support the weight of the infant user as it rotates.

Referring more specifically to FIGS. 6, 8, 8*a* and 9 wherein a pivot arm 17 is removably connected at the outer end of the pivot arm bracket 16 and is made of metal, plastic or wood in a circular, square or oval shape. The connecting end 37 of pivot arm 17 is reduced in dimensions to be received by outer end of pivot arm bracket 16 and is held in place by a locking pin 38 through throughholes 36 in both pivot arm 17 and pivot arm bracket 16. The pivot arm 17 is detached for storage or portability. FIG. 8*a* is an additional pivot arm comprising a vertical riser 17*a*, then extending outwardly at outer end of straight portion 17*b*. A pivot arm swivel 41 is placed on top of outer end of pivot arm 17, although, pivot arm swivel 41 can also be placed on inside of pivot arm 17. An eyebolt 40 or preferred embodiment with means of connecting multiple attachments extrudes through pivot arm 17 through a throughhole and connects to top of pivot arm swivel 41 and held in place by a locknut 41*a*.

Referring more specifically to FIGS. 8, 8*a*, 9 and 10 wherein Upper cord housing 18 is removably connected to eyebolt 40 wherein upper cord housing 18 is preferably a sphere or prism shaped embodiment with means of attaching to eyebolt 40 using a hook 61.

An elasticized cord comprising two sides 51 and 62 connected to upper cord housing 18 wherein stationary side 51 is fixedly held in place by a clamp 60 at upper end of upper stationary cord opening 59 suspending downward to lower cord housing 20 through lower stationary cord opening 55 onto lower groove of pulley assembly 54. Adjustable end of elasticized cord 62 extends upwardly through lower adjustable cord opening 56 to interior of upper cord housing 18 wherein adjustable end of elasticized cord 62 extends through adjustable cord opening 58 which gradually reduces downward to a lesser opening 63 enabling adjustable end of elasticized cord 62 to lock in place after obtaining desired length. A handle embodiment 57 is connected to adjustable end of elasticized cord 62 by a clamp to allow ease of use when adjusting, and locking elasticized cord onto upper cord housing lock 63.

A harness 71 shown in FIG. 10 is preferably made of fabric such as fleece, cotton, canvas, spandex, or any other desired material may be used. At polar ends of harness are harness handles 70 of triangular shape preferably formed of hard plastic or metal embodiment used to removably attach to the lower elasticized cord housing hook 53 shown in FIG. 9. Harness 71 will comfortably wrap infant torso allowing him/her to suspend at desired height so that infant hands and knees are positioned on the padded flooring 150 shown in FIG. 12.

Referring to FIGS. 11-11*a* wherein support embodiment is made of a metal, plastic, or wood suitable to withhold the weight requirement to support infant/user. A support ring 341 is bolted to upper end of jumper support housing 340*a* from upper end of support handle 343*a*. The ends of support handle 343*a* are threaded and insert through throughholes 345 of jumper support housing 340*a* and fixedly locked in place by threaded lock nuts 343*b*. A support hanger opening 340*b* is shaped to receive support hanger 342, wherein center of support hanger 342 is fixedly bolted to inside of jumper support housing 340*a* by a hanger bolt 344*a* and hanger nut 344*b*. At each end of support hanger 342 is a groove shaped to receive jumper ropes 302 wherein each end removably slides into grooves to support jumper seat 300.

The padded jumper seat 300 is preferably made of polyester, canvas, wool or any washable material. The jumper cords 302 are fixedly connected to jumper seat 300 by a cord support 301 that receives jumper ropes 302 at upper end and are preferably sewn or stitched together, then rope housing 301 is sewn or stitched to jumper seat 300.

Referring to FIG. 12-12*a* Padded flooring 150 preferably made of a washable foam or any other soft, cushioned, and washable material. Padded flooring 150 may also preferably contain miscellaneous designs with different color schemes prints. Each piece of floor padding 150 removably interconnects to adjoining ends 93 to cover support legs 410 extending floor to desired shape, preferably circular, hexagonal, or square. Floor padding 150 will preferably have a cutout on bottom of inner edge 91 to match shape of vertical legs 410*a* and lower column 402 in order to place padded flooring 150 on top of support legs 410 to create a low profile flooring.

Referring to FIG. 13 is an alternate embodiment of the base support means from the lower end, comprising a sub plate 10 with support bars 12 wherein both are preferably made of metal, plastic or wood material with a circular, square or oval shape that can be locked in place to stabilize the apparatus. The support bars 12 will preferably extend out to length of desired floor padding allowing a structurally sound sub floor. The support bars 12 hingedly connect 12*a* to stabilizer bracket 11 from inner end of support bars 12, below sub plate, using preferably standard bolts through throughholes wherein support bars 12 pivot upwardly from inner end of support bars 12. When in the down position stabilizer bars 12 are locked in place by a locking pin 100 at the outer end of the stabilizer bracket 11 through throughholes 11*a*.

Connected to the sub plate 10 is a column 13 preferably made of metal, plastic or wood material with a circular, square or oval shape that is attached to the center of sub plate 10 at the lower end preferably by weldment with the upper guide plate 14 attached to the upper end of column 13.

As shown particularly in FIG. 5 that by loosening the threaded locking knobs 404 and removing the column 13 to detach upper portion of present invention, the device can be stored in a reduced dimension and easily transported to desired destinations.

What is claimed is:

1. A portable infant crawler-walker motor skill development apparatus comprising, in combination:

a structural frame having support legs covered by a padded floor, the support legs having means of fixedly attaching to a center column, a guide wheel plate being generally circular having means of fixedly abutting a top of the center column, a bearing assembly centrally mounted securedly on top of said guide wheel plate having means of securing an elongated pivot arm bracket to a center of said bearing assembly wherein at least one guide wheel is perpendicularly connected to a lower portion of an opposite end of a bearing assembly connection for moment support, wherein an outermost end of said pivot arm bracket having a communicating aperture adapted with means to receive a pivot arm;

a removable pivot arm having a reduced end adapted to connect inwardly to the aperture of said pivot arm bracket, a ring member is rotatably depending from a lower portion of an outermost end of said removable pivot arm to receive a cord;

a removable adjustable cord, the removable adjustable cord having a resilient cord adjoining an upper and lower housing, the upper housing having a means of removably connecting to said ring member, the lower housing having a hook member on a lower portion removably connecting to either a crawling or a walking harness attachment, the resilient cord loops around an axle on the lower housing with one fixed end and one adjustable end extending upward to the upper housing, whereby adjusting height of the lower housing with said resilient cord having means of releasably securing upon a single motion;

an infant crawling torso wrap, the infant crawling torso wrap having a generally rectangular shape with a torso receiving portion with extended opposing ends, each end having means of simultaneously removably connecting to said hook member on said lower housing of said adjustable cord; and an infant walking harness, the infant walking harness having a generally cylindrical shaped hub with a hollow interior and having two diametrically opposite slotted apertures to receive a centrally positioned crossmember with two ends extending outwardly, each end having diagonal slotted apertures on upper portions thereof , a suspending harness with means of attaching two cords, each cord forming a loop with the ends of each cord fixedly connected to diametrical ends of an upper portion of the harness, the loop portion of cords removably suspend in the diagonal slots on each outward end of said crossmember, a connecting ring member having a centrally positioned upper opening abuts an upper portion of the hub with a lesser diameter opening extends inwardly through a center of the hub, a handle being generally u-shaped with each end being threaded, the handle ends extend through througholes on said hub with an upper threaded end fixedly extending through a lower portion of the connecting ring and locked by a nut.

2. The apparatus described in claim 1, consisting of multiple attachment pivot arms, each pivot arm vertical length is depending on an associated attachment suspending from the lower end of said removable adjustable cord, an outermost end of each said pivot arm is adapted with a swivel means attached to said ring member allowing said ring member to freely spin about said removable adjustable cord and suspended attachment thereof.

3. The apparatus described in claim 1, wherein said removable adjustable cord upper housing has a downwardly extending aperture therein for passage of said resilient cord, the upper portion of the downwardly extending aperture being circular reducing to a lesser opening whereby said resilient cord extends through the upper portion and pushed down to the lesser opening to adjustably lock said resilient cord.

4. The apparatus described in claim 1, wherein said infant crawling harness is made of a foldable comfortable material wherein each elongated end has a connecting member having a rear end shaped to simultaneously hold each elongated end, where a front end of said connecting member is offset so that when suspended, a frontal portion of torso wrap is of a higher elevation, the torso wrap is shaped to conformally wrap an infant front torso without interfering infant crawling movements of arms and legs, whereby supporting and promoting an infant to freely and comfortably crawl about the padded floor.

* * * * *